US007351189B2

(12) United States Patent
Stäb

(10) Patent No.: US 7,351,189 B2
(45) Date of Patent: Apr. 1, 2008

(54) CUTTING DEVICE FOR THE TRANSVERSE CUTTING OF AT LEAST ONE MATERIAL WEB

(75) Inventor: Rudolf Stäb, Frankenthal (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 292 days.

(21) Appl. No.: 10/505,872

(22) PCT Filed: Feb. 28, 2003

(86) PCT No.: PCT/DE03/00673

§ 371 (c)(1),
(2), (4) Date: Sep. 3, 2004

(87) PCT Pub. No.: WO03/074402

PCT Pub. Date: Sep. 12, 2003

(65) Prior Publication Data

US 2005/0160889 A1 Jul. 28, 2005

(30) Foreign Application Priority Data

Mar. 4, 2002 (DE) ..... 102 09 190

(51) Int. Cl.
*B31F 1/00* (2006.01)

(52) U.S. Cl. ..... 493/432; 493/428

(58) Field of Classification Search ..... 493/432, 493/428, 427, 429, 439, 448; 83/343, 344, 83/345, 152, 94, 154
See application file for complete search history.

(56) References Cited

U.S. PATENT DOCUMENTS

| | | | | |
|---|---|---|---|---|
| 2,891,791 | A * | 6/1959 | Chase | 493/432 |
| 4,279,410 | A * | 7/1981 | Bolza-Schunemann | 270/6 |
| 4,441,390 | A * | 4/1984 | Hechler et al. | 83/154 |
| 4,559,032 | A * | 12/1985 | Fischer | 493/432 |
| 4,754,959 | A | 7/1988 | Kobler et al. | |
| 4,811,641 | A * | 3/1989 | Muller | 83/105 |
| 5,024,128 | A * | 6/1991 | Campbell, Jr. | 83/26 |
| 5,494,270 | A | 2/1996 | Laubscher | |
| 5,503,379 | A | 4/1996 | Michalik et al. | |
| 6,733,431 | B2 * | 5/2004 | Dufour | 493/428 |
| 6,941,862 | B2 * | 9/2005 | Weiler | 101/227 |
| 7,011,616 | B2 * | 3/2006 | Mamberer et al. | 493/365 |
| 7,115,087 | B2 * | 10/2006 | Held et al. | 493/428 |

FOREIGN PATENT DOCUMENTS

| | | |
|---|---|---|
| DE | 239837 | 4/1910 |
| DE | 35 27 710 A1 | 2/1987 |
| DE | 93 20 814.6 | 3/1995 |
| DE | 100 60 758 A1 | 7/2001 |
| EP | 0 627 310 A1 | 4/1994 |
| JP | 10-194588 | 7/1998 |

* cited by examiner

*Primary Examiner*—Sameh H. Tawfik
(74) *Attorney, Agent, or Firm*—Jones, Tullar & Cooper, P.C.

(57) ABSTRACT

A cutting device is used to accomplish the transverse cutting of at last one material web. The cutting device includes a transport cylinder that is arranged to form a first cutting gap in cooperation with a first transverse cutting device. The transport cylinder is also arranged with a second transverse cutting device to form a second cutting gap.

19 Claims, 7 Drawing Sheets

CUTTING DEVICE FOR THE TRANSVERSE CUTTING OF AT LEAST ONE MATERIAL WEB

CROSS-REFERENCE TO RELATED APPLICATIONS

This application is the U.S. National Phase, under 35 USC 371, of PCT/DE 03/00673, filed Feb. 28, 2003; published as WO 03/074402 A1 on Sep. 12, 2003 and claiming priority to DE 102 09 190.0 filed Mar. 4, 2002, the disclosures of which are expressly incorporated herein by reference.

FIELD OF THE INVENTION

The present invention is directed to a cutting device for the transverse cutting of at least one web of material, to a conveying cylinder of a folding apparatus, as well as to a method for operating a folding apparatus. The cutting device has a conveying cylinder which cooperates with at least a first transverse cutting device. Two material webs can contact the conveying cylinder at two offset locations. The webs may be provided with various patterns.

BACKGROUND OF THE INVENTION

A cutting device is typically employed, for example, for separating paper webs, which were imprinted on a web-fed rotary printing press. The paper webs are cut into individual signatures.

Generally known cutting devices of this type typically include a conveying cylinder and a cutting cylinder, which cylinders are rotatable together and delimit a gap through which a conveying path of the web of material to be cut extends. The cutting cylinder supports at least one cutting blade, which cuts each signature off the web of material when the web passes through the gap.

DE 35 27 710 A1 and EP 0 627 310 A1 both disclose folding apparatus, in which two folding blade cylinders act together with a folding jaw cylinder. Each folding blade cylinder is assigned a single cutting cylinder.

DE 93 20 814 U discloses a method for operating a folding apparatus. Two webs are separately fed to a conveying cylinder.

DE 239 837 C describes a cutting device for the transverse cutting of webs of material. A cutting and conveying cylinder, together with two counter-cylinders, forms respective cutting gaps.

SUMMARY OF THE INVENTION

The object of the present invention is directed to providing cutting devices for transverse cutting of at least one web of material, to a conveying cylinder of a folding apparatus with a holding device, as well as to methods for operating a folding apparatus.

In accordance with the present invention, this object is attained by the provision of a cutting device that is usable for the transverse cutting of at least one web of material. The cutting device has a conveying cylinder that forms a first cutting gap in cooperation with a first transverse cutting device. The conveying cylinder may also form a second cutting gap in cooperation with a second transverse cutting device. The conveying cylinder may receive two webs of material to be cut with these two webs being fed to the conveying cylinder at two circumferentially offset inlets.

Holding devices may be provided for grasping the webs of material. Various patterns or arrangements of material can be carried by the webs.

The advantages to be gained by the present invention lie, in particular, in that it makes possible the joining of two webs of material, which two webs of material are fed to the conveying cylinder on two conveying paths, into a common products. The present invention also permits the processing of a web of material having a large number of layers by putting the web of material together from two partial webs.

For several reasons, the processing webs of material, which webs are composed of a large number of layers, by the use of conventional cutting devices, entails difficulties. One difficulty is that traction rollers, which are customarily provided for setting a required tension of the web of material, only act directly on the outer layers of the web of material. Their tractive force is indirectly transferred to the inner layers only by friction of the layers of material with respect to each other. These frictional forces cannot be controlled exactly, particularly not in cases where the web must be guided around curves, i.e. where the web is looped around a roller. The tension of the inner layers of such a web is therefore all the more difficult to control, the greater the number of layers. Also, the forces required for processing the web, either during cutting, or when punching spur holes into the web, are greater, the greater the number of its layers. These forces are reduced in the cutting device. It is therefore possible to construct the cutting device lighter, and therefore less expensively than a conventional one, without a loss of quality.

To prevent that, during the course of the first web passing through the second cutting gap, the second cutting blade again cuts the first web, the rotation of the two cutting cylinders is preferably synchronized. During its passage through the second cutting gap, the second cutting blade strikes a cut in the first web which was made by the first cutting blade.

To make the striking of this cut by the second cutting blade easier, the cutting edges of the first web, which edges were formed by the first blade during its cutting, are moved apart from each other. In the course of its passage through the gap, the second blade encounters a gap of non-disappearing width in the first web.

Different preferred embodiments of devices and of methods for moving the cut edges apart are described in the preferred embodiments of the present invention.

The cutting device preferably is a part of a folding apparatus. In particular, the conveying cylinder can also function simultaneously as the folding blade cylinder of the folding apparatus.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
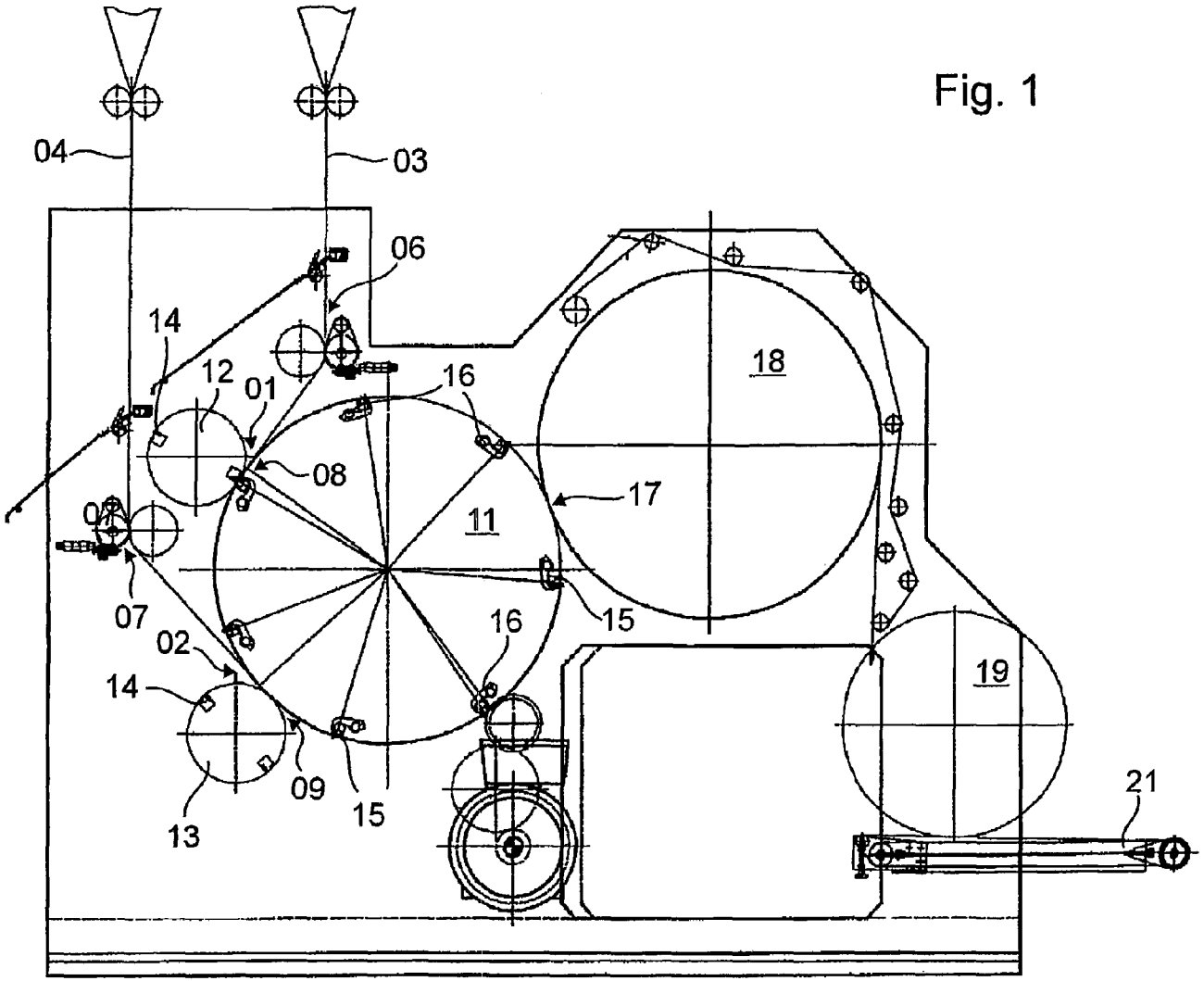
FIG. 1, a schematic side elevation view of a folding apparatus with a cutting device in accordance with the present invention, in FIGS. 2 to 5, partial sections of a conveying cylinder and a cutting cylinder in different embodiments of the present invention, in FIG. 6, a schematic representation of a first mode of operation, and in FIG. 7, a schematic representation of another, second mode of operation.

A schematic side elevation view of a folding apparatus is represented in FIG. 1. This folding apparatus has two web inlets 01, 02 for the receipt of multi-layered webs 03, 04 of material, in particular paper webs 03, 04, which multi-layered webs 03, 04 will be hereinafter identified as the inner web 03 or as the outer web 04 in what follows. Both webs 03, 04 pass through a respective traction roller pair 06, 07, respectively for setting their tension and both webs then encounter a conveying cylinder 11 at the height of respective first and second cutting gaps 08, 09. These gaps 08, 09 are formed between the conveying cylinder 11, on the one hand, and one of two cutting cylinders 12, 13 on the other hand. In place of two inlets 01, 02 and two cutting gaps 08, 09, it is also possible to provide three or more inlets and cutting gaps. In the course of this web travel, the webs 03, 04 preferably first come into contact with the conveying cylinder 11, and thereafter with the respective cutting cylinders 12, 13, i.e. the webs 03, 04 first loop around the conveying cylinder 11 and then around the counter cylinders 12, 13.

Each one of the first and second cutting cylinders 12 or 13 has a circumference corresponding to at least one, and preferably corresponding to two lengths of the signatures to be produced from the webs 03, 04. Each cutting cylinder 12 and 13 also supports two cutting blades 14.

The circumference of the conveying cylinder 11 corresponds to the length of more than five, and in particular to the length of seven signatures. Seven counter-cutting strips, for example seven hard rubber strips, are used as backstops 15, each of which backstops 15 works together with a cutting blade 14 when cutting the webs 03, 04. A holding device 16, for example a spur strip 16, with spur needles 23 which can be extended as may be seen in FIGS. 2 to 5, is arranged on the conveying cylinder 11 adjoining each backstop 15.

In the position of the cutting device represented in FIG. 1, a cutting blade 14 of the first cutting cylinder 12 and a backstop 15 of the conveying cylinder 11 are just passing through the first cutting gap 08 and, in the process, cooperate to cut the inner web 03. The leading edge of the inner web 03, which is formed by this cut, is spiked on the spur needles 23 of a spur strip 16, which spur strip 16 had been extended briefly prior to reaching the first cutting gap 08 and which also fixedly holds the inner web leading edge on the surface of the conveying cylinder 11 during further conveying.

The signature cut off the inner web 03 in this process is conveyed on by the conveying cylinder 11 to the second cutting gap 09, where the outer web 04 is placed on top of it and is also spiked by the spur needles 23 of the spur strip.

The rotation of the two cutting cylinders 12, 13 is synchronized in such a way that a cutting blade 14 of the second cutting cylinder 13 always passes through the second cutting gap 09 simultaneously with the passage of a narrow gap which has been formed between two successive signatures cut from the inner web 03 and with the passage a backstop 15. Different techniques for forming this gap will be explained in what follows by the embodiments of FIGS. 2 to 5.

In the example represented in FIG. 1, the angular distance between the two cutting gaps 08, 09 is approximately 50°. This cutting gap angular distance can differ from the angular distance of the spur strips 16 from each other, which is typically 51.5°, or from a multiple thereof, so that cutting is not performed simultaneously at both cutting gaps 08, 09. A half-integral multiple of this value is also disadvantageous from the viewpoint of vibration avoidance.

Following its passage through the second cutting gap 09, each spur strip 16 supports a whole product, which is composed of a signature cut off the inner web 03 and a signature cut off the outer web 04. Seven whole signatures, or products are formed in the course of every revolution of the conveying cylinder 11 in the same way as if both webs 03, 04 were fed via a common inlet 01, 02 in the customary way. However, since the cutting of each individual signature is spaced over two separate cutting steps at the first and second cutting gaps 08, 09, the force required to be provided in each cutting step is less. The result is that a satisfactory synchronous running of the machine is easier to maintain.

Furthermore, seven folding blades, which are not specifically represented in FIG. 1, are attached to the conveying cylinder 11, each of which folding blades is extended when reaching a gap 17 between the conveying cylinder 11 and a folding jaw cylinder 18 in order to transfer the products conveyed by the conveying cylinder 11 to the folding jaw cylinder 18 in a manner that is known per se, and to thereby fold them. The folded products are then transferred from the folding jaw cylinder 18 to a bucket wheel 19 and are deposited by the bucket wheel on a conveyor belt 21.

Figure 2:
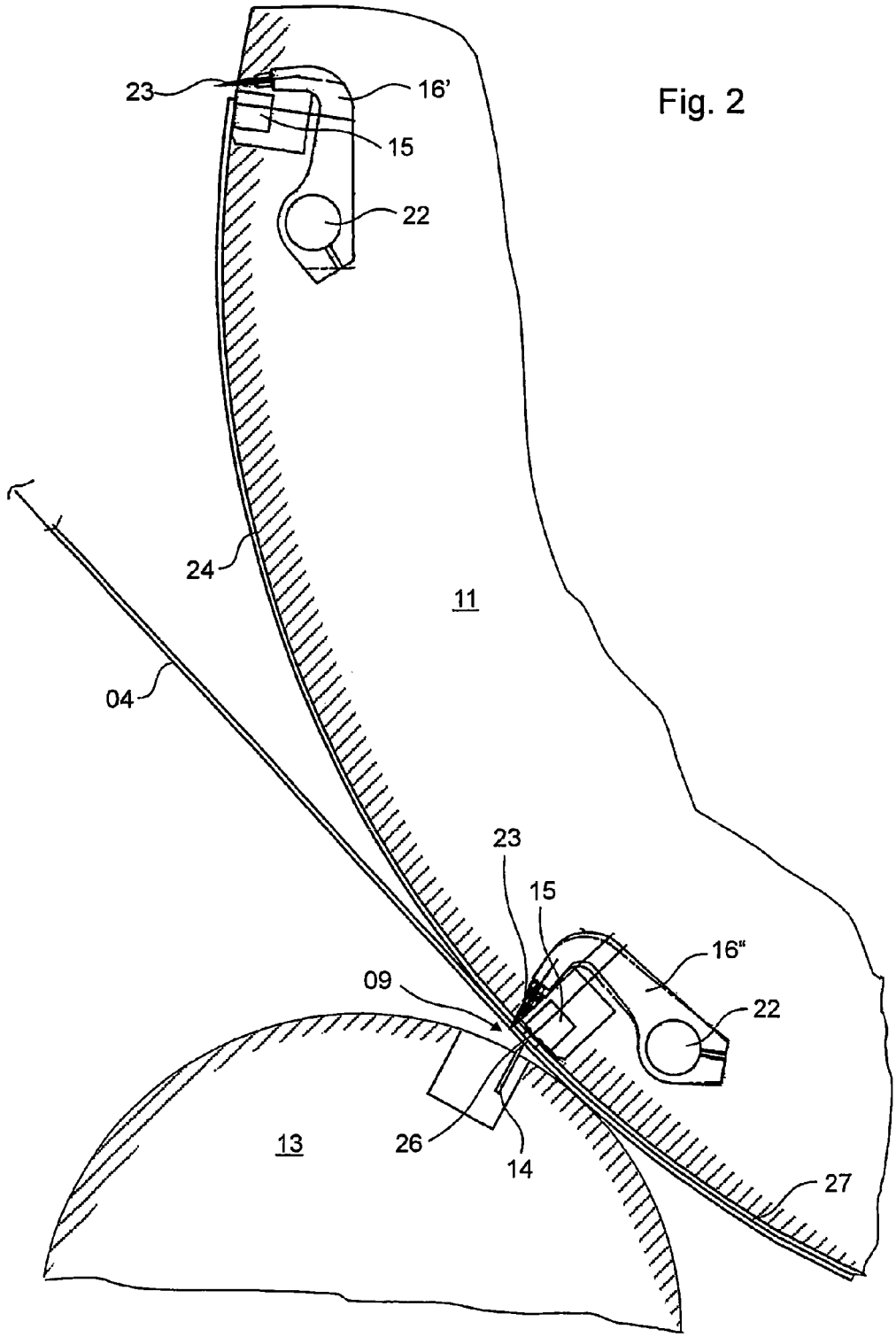

FIG. 2 shows a detailed view of a first preferred embodiment the second cutting gap 09 and its surroundings in accordance with the present invention. Two of the seven spur strips 16 of the conveying cylinder 11 are represented in FIG. 2 and are indicated as first and second spur strips 16', 16", respectively. Spur strips 16', 16" are each pivotable around a shaft 22 in a controlled manner and each support spur needles 23 which are oriented in such a way that their tips can out of the circumference of the conveying cylinder 11 and are each located farther away from the center of the shaft 22 than are their bases that are located in the interior of the conveying cylinder 11. The spur needles 23 of the first spur strip 16', as depicted in FIG. 2, are in a comparatively far or full extended position in which full extended position they previously had also passed through the first cutting gap 08. This same position is shown in dashed lines at the location of the second spur strip 16".

In comparison with the first spur strip 16', the second spur strip 16" is shown in FIG. 2 as being pivoted back some distance farther into the interior of the conveying cylinder 11. This retraction pivot movement results in a displacement of the line of intersection between the spur needles 23 and the surface of the conveying cylinder 11 opposite to the direction of rotation of the conveying cylinder 11. Because of this displacement, the signature 24 held by the spur strip 16" has been slightly displaced on the circumferential surface of the conveying cylinder 11 opposite to the direction of rotation of the conveying cylinder 11 in comparison with the position in which signature 24 was cut off from the inner web 03 at the first cutting gap 08. After passing through the second cutting gap 09, the second spur strip 16" returns back into the original, extended position that is indicated by dashed lines, or even makes a transition to an even further extended position, in order to cancel, or to overcompensate for the prior retrograde displacement of the signature 24. In this way, a narrow gap is initially formed between each signature 24 and a previous signature 27, which had been cut off immediately prior to it, into which narrow gap the cutting blade 14 of the second cutting cylinder 13 can enter, and in this way the cutting device can push the outer web 04 against the backstop 15 and can cut it without risking the danger of again cutting one of the signatures 24, 27.

Figure 3:
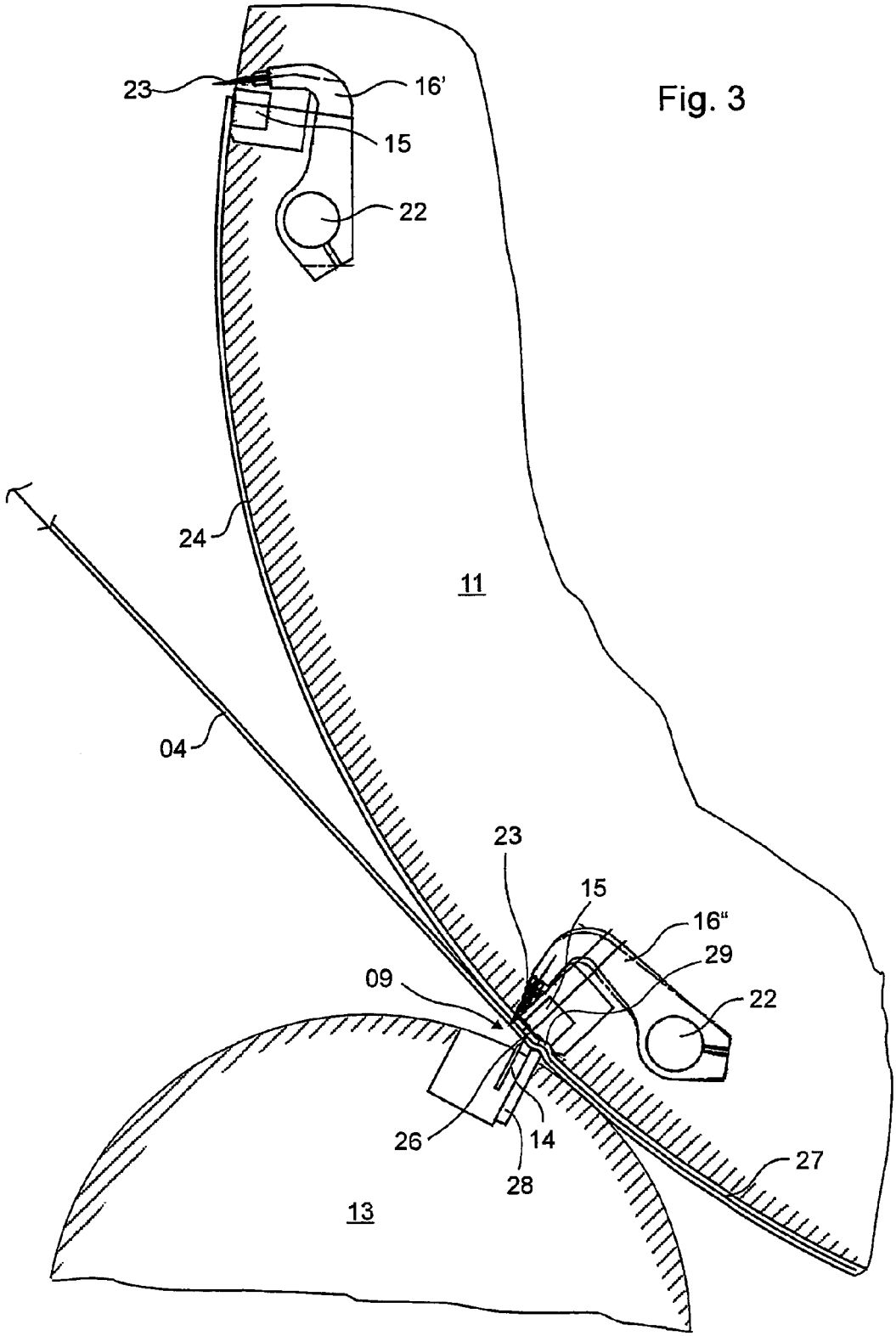

FIG. 3 shows an alternative embodiment of the conveying cylinder 11 and of the cutting cylinder 13 in a partial sectional view that is analogous to that of FIG. 2. With respect to each cutting blade 14, in this embodiment the cutting cylinder 13 has a strip 28 extending axially along, and projecting radially past its exterior circumference, which strip 28 passes through the cutting gap 09 shortly before the associated cutting blade 14. A complementarily shaped groove 29 is provided in the circumferential surface of the conveying cylinder 11 and is located opposite the strip 28 during each passage of strip 28 through the gap. The strip 28 pushes a trailing edge area of the signature 27 cut off the inner web 03, as well as the outer web 04, just in advance of what will be a leading edge, into the groove 29. Therefore, with this embodiment it is not necessary for the second spur strip 16" to be pivoted outward again after its passage through the cutting gap 09 in order to create the gap 26.

A third embodiment is represented in FIG. 4, again by the use of a partial section through the conveying cylinder 11 and the second cutting cylinder 13. The second cutting cylinder 13 is identical to the second cutting cylinder 13 shown in FIG. 2. The conveying cylinder 11 of the third embodiment differs because of the arrangement of the shafts 22 around which the spur strips 16 can be pivoted. While in the embodiments of FIGS. 2 and 3, these shafts 22 are located ahead of the spur needles 23, in the direction of rotation of the conveying cylinder 11, these shafts 22 are arranged behind the spur needles 23 in the embodiment of FIG. 4. The orientation of the spur needles 23, in relation to the surface of the conveying cylinder 11, is the same in all cases. They are slightly inclined forward, opposite the normal surface, and in the direction of rotation of the conveying cylinder 11, so that a tension, acting on the material spiked on the spur needles 23, keeps the material pressed against the surface of the conveying cylinder 11.

Figure 4:
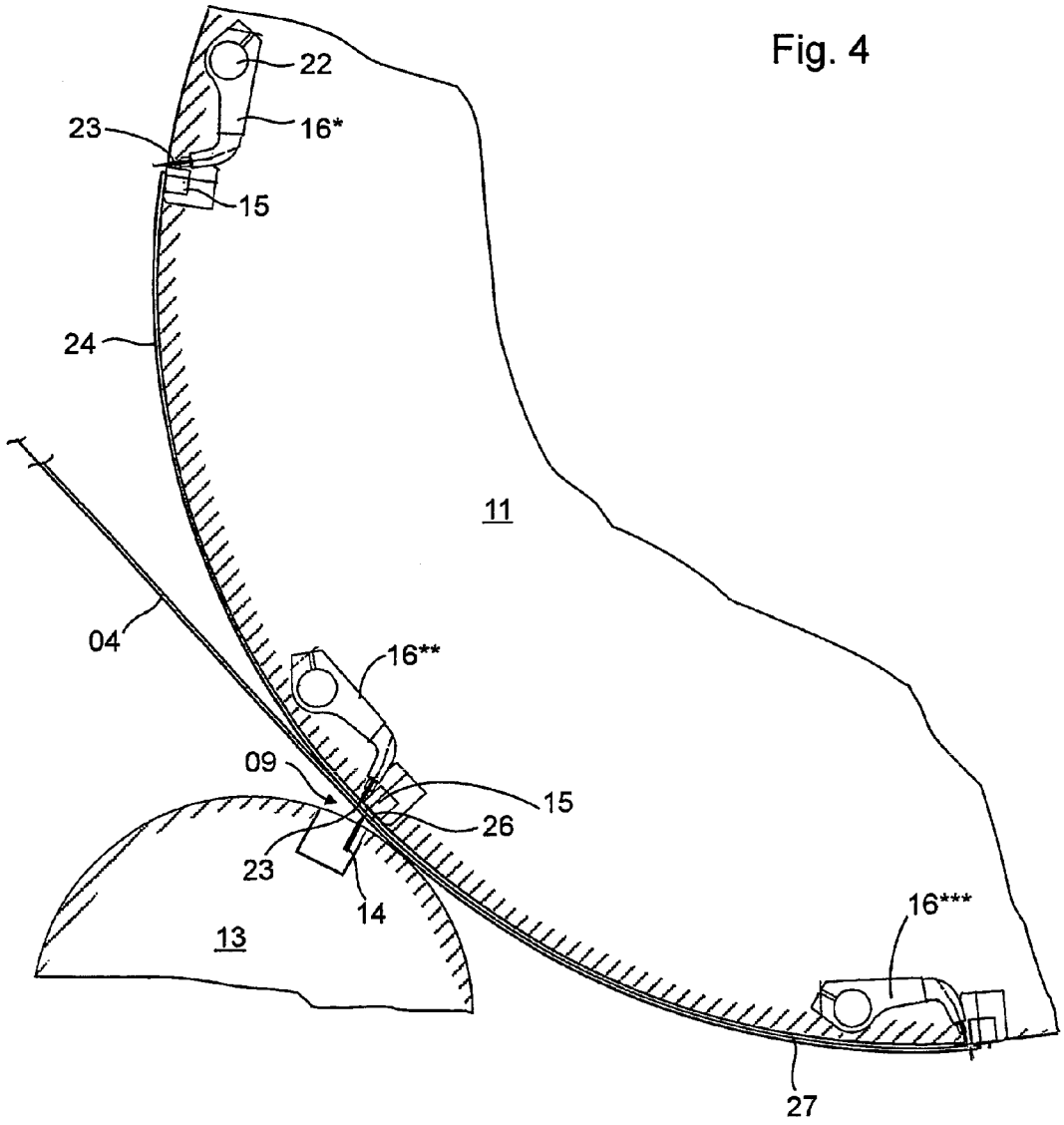
Figure 5:
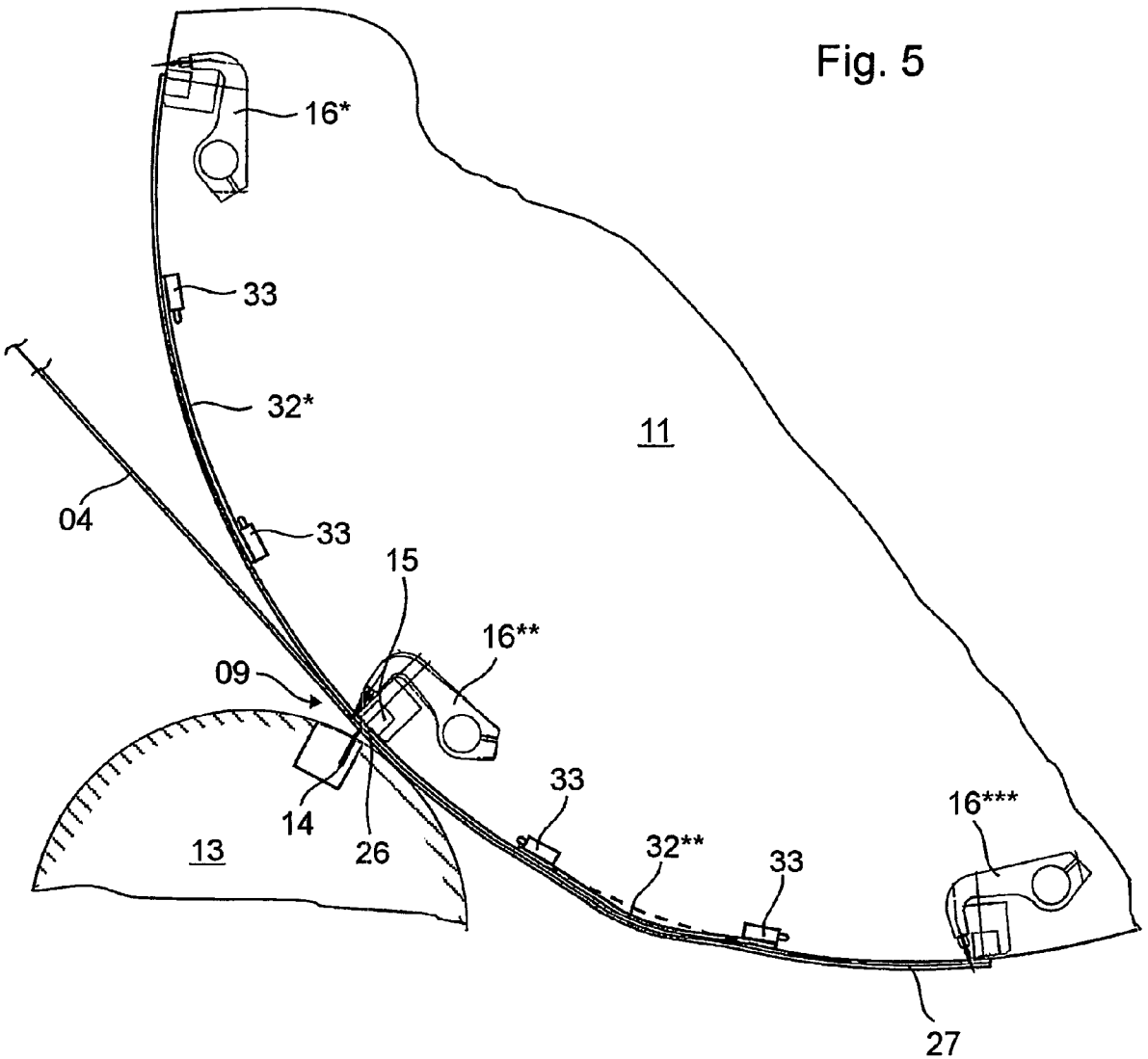

A changed sequence of the pivoting movement of the first and second spur strips, here identified as 16*, 16, results from the changed arrangement of the shafts 22 shown in FIG. 4. The first spur strip 16*, which is still far removed from the second cutting gap 09, is in a comparatively only slightly extended position, in which slightly extended position, its spur needles 23 extend far enough past the circumference of the conveying cylinder 11 for holding an incoming inner web 03. The first spur strip 16* is farther extended only shortly prior to reaching the second cutting gap 09 for also now spiking the outer web 04, as can be seen by reference to the second spur strip 16**. In this third embodiment, the radially outward movement of the spur needles 23 causes a displacement of their intersection with the circumference of the conveying cylinder 11 in a direction opposite to the direction of movement of the conveying cylinder 11, and therefore a movement of the leading edge of the signature 24 held by the second spur strip 16** away from the impact point of the second cutting blade 14 on the backstop 15. The spur needles 23 of the third spur strip 16*** have now been retracted radially some distance back into the conveying cylinder 11 in order to move the signature 27, which they hold, forward in the circumferential direction and to open the gap 26 at the level of the backstop 15** in this way.

With this third embodiment, several directional changes in the movement of the spur needles 23, in the course of a revolution of the conveying cylinder 11, are avoided.

A fourth embodiment of the cutting device in accordance with the present invention is represented in FIG. 5, again in a partial sectional view that is analogous to FIG. 4.

In this fourth embodiment, first and second cylinder surface segments 32*, 32, as well as other similar segments, which are not specifically shown, are arranged on the circumference of the conveying cylinder 11 between each two of first, second and third successive spur strips 16*, 16**, 16*** respectively. These segments 32*, 32** are utilized for temporarily increasing the circumference of the conveying cylinder 11. Each one of these segments 32*, 32**, is composed of a plurality of flexible plates, which are arranged side-by-side in the axial direction of the conveying cylinder 11 and which are also spaced apart axially by gaps. During the transfer of the finished cut signatures 24, 27 to the folding jaw cylinder 18, these axially spaced gaps between axially adjacent segments 32*, 32** are used as respective outlet openings for tines of a folding blade, which is not specifically represented. The ends of the flexible plates are each anchored to top strips 33 which top strips 33 can be displaced in the circumferential direction of the conveying cylinder 11**.

The first cylinder surface segment 32* is in a configuration in which the course of its plates corresponds to the cylindrical shape of the conveying cylinder 11. After the passage of such a first segment 32* through the second cutting gap 09, its top strips 33 are displaced toward each other, so that its flexible plates, as indicated for the second segment 32, form a protrusion extending radially outwardly past the circumference of the conveying cylinder 11. As a result of this radially outwardly extending protrusion, the distance between the first and second spur strips 16* and 16**, as measured along the surface of the conveying cylinder 11, is greater than the distance between the second and third spur strips 16** and 16*****, the latter distance corresponding to the length of the signatures 24, 27 produced at the first cutting gap 08. Therefore, the bulging of the second cylinder surface segment 32** causes the formation of the gap 26 between the signatures 24 and 27, into which newly formed gap 26 the cutting blade 14 of the second cutting cylinder 13** can enter.

The second transverse cutting device 11, 13 is arranged with a phase offset on the circumference of the conveying cylinder 11 for cutting.

The cut of the first transverse cutting device 11, 12 on the cutting cylinder 11 takes place closely next to the other cut of the second transverse cutting device 11, 13, in particular within a distance of 10 mm next to it.

The first and second transverse cutting devices 11, 13 are arranged on the conveying cylinder 11 in the circumferential direction.

In all of the modes of operation of the cutting device in accordance with the present invention, a further conveying cylinder for taking over the signatures can be located downstream, in the direction of signature travel, instead of the folding jaw cylinder 18, downstream of which future conveying cylinder a folding jaw cylinder or a belt system can be arranged.

It is also possible for each of the webs 03, 04 to have the same patterns A or B located one behind the other, i.e. in the conveying direction. Preferably these patterns A and B are imprinted by the use of at least one forme cylinder of a printing unit, which forme cylinder has two identical patterns A and B on its circumference. The webs 03, 04 are guided to an orientation on top of each other, so that signatures, with patterns A and B located on top of each other, are formed, each of which signatures is transferred to the downstream located folding jaw cylinder 18 in the gap 17. The conveying cylinder 11 does not have to have an odd-number of surface divisions for this operation, but instead can also have an even-number of surface divisions, which number is preferably greater than 4 or 6.

Figure 6:
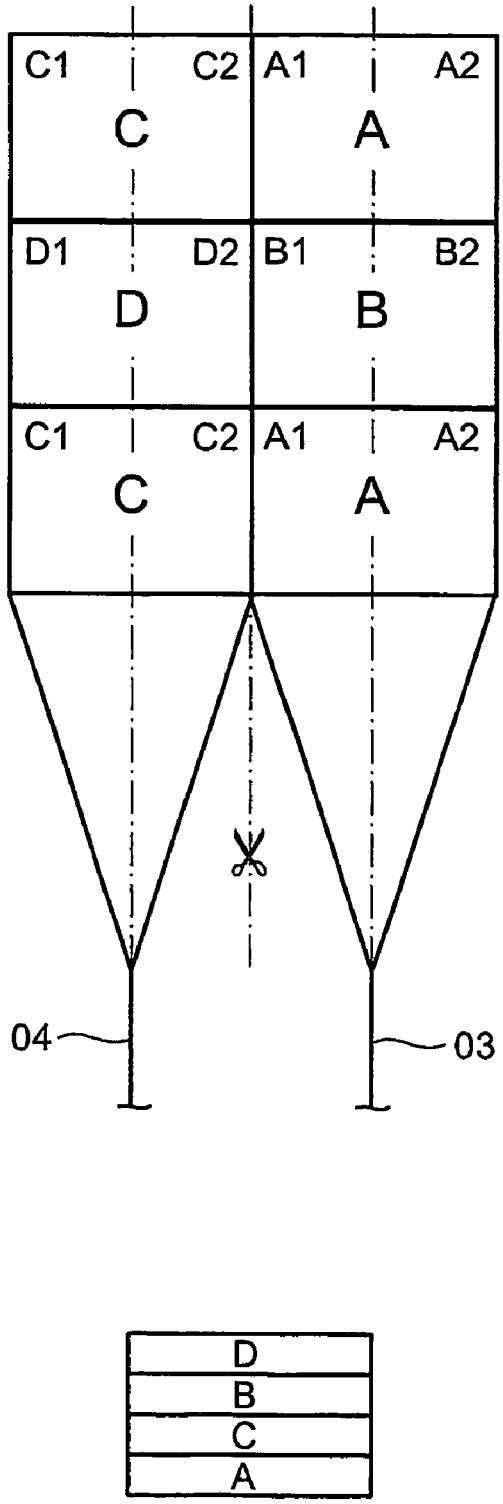
Figure 7:
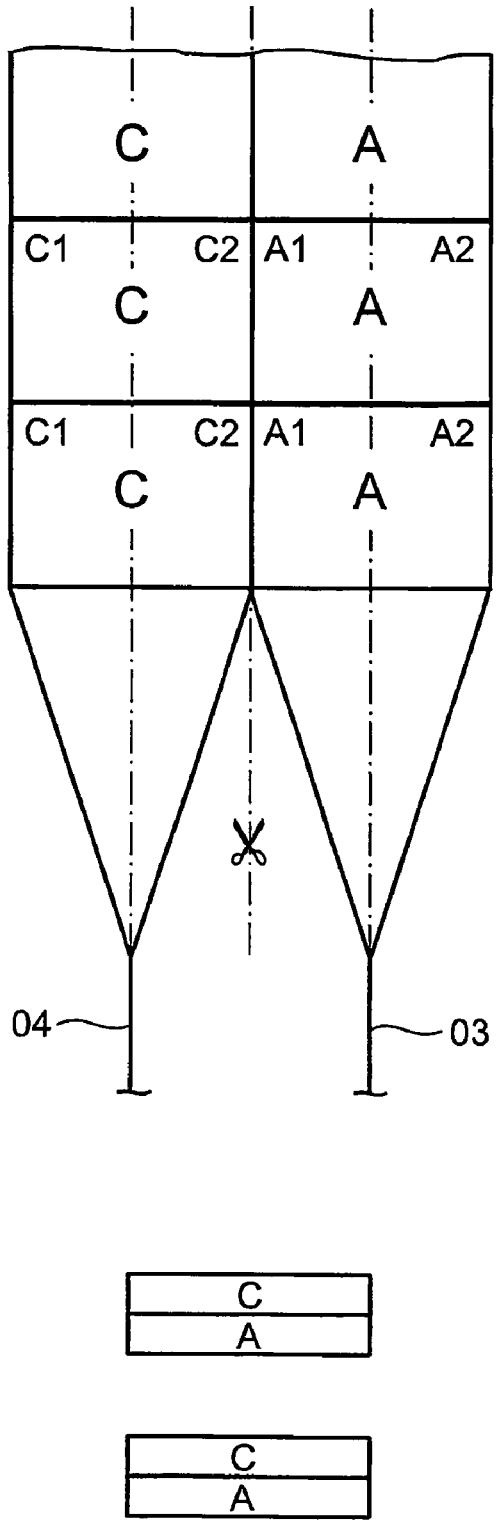

Preferably, each of the patterns A, B, C, D, as seen in FIGS. 6 and 7 identifies two newspaper pages, wherein A1, A2, B1, B2, C1, C2, D1, D2 each identify a single newspaper page, also as seen in FIGS. 6 and 7.

The identification of a web 03, 04 is understood to represent at least one web 03, 04, but preferably should be understood to be used to identify a strand consisting of several webs 03, 04 which are placed on top of each other.

The webs 03, 04 can each be imprinted by the use of forme cylinders of printing units which either have a pattern A or B on the cylinder circumference, in a single circumference cylinder, or two patterns A or B on the cylinder circumference, in a double circumference cylinder. With double circumference forme cylinders, two identical patterns A, A, or B, B, or two different patterns A, B can be arranged on the cylinder circumference.

Four modes of operation of the present invention are possible.

In a first and in a second mode of operation, both webs 03, 04 are brought together on the conveying cylinder 11 ahead of either the first inlet 01, or the second inlet 02 and are severed in the course of a single cutting operation.

In this case, in the first mode of operation, the two webs 03, 04 have identical patterns A or C in sequence, and the same products are formed sequentially on the conveying cylinder 11 during each revolution and these same products are directly transferred to the downstream located folding jaw cylinder 18.

In the second mode of operation, the webs 03, 04 have patterns A, B or C, D, respectively, which patterns alternate behind each other and which are alternatingly deposited on the conveying cylinder 11 during a first revolution of the conveying cylinder 11, which is provided with an odd number of fields, and is thus a collection cylinder, and are additionally provided with a second layer of the folding product portion during the second revolution of the conveying cylinder 11, acting as a collection cylinder.

In a third and in a fourth mode of operation, two webs 03, 04 are separately fed in, wherein in the third mode of operation the webs 03, 04 alternatingly bear the patterns A, B or C, D located one behind the other, as seen in FIG. 6.

In this case, during a first revolution of the conveying cylinder 11, acting as a collection cylinder, first signatures, with the pattern A, C of each web 03, 04, are conducted on all and every second spur strip 16, so that now every second spur strip 16 carries a signature with the pattern A, C, and during the second revolution again two signatures with the pattern B, D from each web 03, 04 are conducted on the spur strips 16.

Therefore, during the second revolution of the conveying cylinder 11, signatures A, C, B, D on the spur strips 16 alternate with spur strips 16 carrying only signatures with the patterns A, C, wherein the signatures, i.e. the product with the pattern A, B, C, D of each second field, are transferred to the folding jaw cylinder 18.

In a fourth mode of operation, the webs 03, 04 have identical patterns A, A, or C, C located behind each other, as seen in FIG. 7, so that with each revolution of the conveying cylinder 11, each spur strip 16 carries signatures with the pattern A, C, which are directly transferred to the folding jaw cylinder 18 when they arrive there.

While preferred embodiments of a cutting device for the transverse cutting of at least one material web, in accordance with the present invention, have been set forth fully and completely hereinabove, it will be apparent to one of skill in the art that a number of changes in, for example the drive for the spur strips and for the cylinders, the structure of the forme cylinders, and the like, could be made without departing from the true spirit and scope of the present invention which is accordingly to be limited only by the following claims.

What is claimed is:

1. A cutting device adapted for the transverse cutting of at least one web of material comprising:

a conveying cylinder having a circumferential surface and a circumferential direction;

a first transverse cutting assembly cooperating with said conveying cylinder and forming a first cutting gap with said conveying cylinder, said first transverse cutting assembly including a first cutting cylinder provided with at least one first cutting cylinder cutting blade, said first cutting gap defining a first conveying path for passage of a first web of material to be cut;

a second transverse cutting assembly cooperating with said conveying cylinder and forming a second cutting gap with said conveying cylinder, said second transverse cutting assembly including a second cutting cylinder provided with at least one second cutting cylinder cutting blade, said second cutting gap defining a second conveying path for passage of the first web of material and a second web of material to be cut; and a plurality of cutting blade engaging backstops on said circumferential surface of said conveying cylinder and spaced in said circumferential direction of said conveying cylinder, said first and second transverse cutting assemblies being arranged offset from each other in said circumferential direction of said conveying cylinder, said at least one first cutting cylinder cutting blade cutting a first signature off the first web in the course of passage of said at least one first cutting cylinder cutting blade through said first cutting gap, said at least one second cutting cylinder cutting blade cutting a second signature off the second web during passage of said at least one second cutting cylinder cutting blade through said second cutting gap, said first and said second conveying paths meeting on said conveying cylinder.

2. The cutting device of claim 1 wherein said at least one second cutting cylinder cutting blade on said second cutting cylinder passing through said second cutting gap is received in a gap formed in the web of material by said at least one first cutting cylinder cutting blade.

3. The cutting device of claim 1 wherein said conveying cylinder circumferential direction has a length equal to at least five signatures cut from the web of material.

4. The cutting device of claim 1 wherein said conveying cylinder is a folding blade cylinder.

5. The cutting device of claim 1 wherein said second transverse cutting assembly is arranged phase-shifted in said circumferential direction of said conveying cylinder with respect to said first transverse cutting assembly.

6. The cutting device of claim 1 wherein said first transverse cutting assembly and said second transverse cutting assembly form cuts located less than 10 mm apart on the web of material.

7. The cutting device of claim 1 wherein rotation of said first cutting cylinder and said second cutting cylinder are synchronized whereby said at least one second cutting cylinder cutting blade is received in a cut made in the first web of material by said at least one first cutting cylinder cutting blade.

8. The cutting device of claim 1 further including means for repositioning cut ends of successive signatures made by said at least one first cutting cylinder cutting blade cutting the first web of material.

9. The cutting device of claim 8 wherein said means for separating said cut ends include first holding devices on said conveying cylinder, said first holding devices holding said first signatures and shifting said first signatures in a direction opposite to a direction of conveyance of said first signatures prior to arrival of said first signatures at said second cutting gap.

10. The cutting device of claim 9 wherein said means for separating said cut ends include second holding devices on said conveying cylinder, said second holding devices holding said second signatures and shifting said second signatures in a direction of conveyance of said second signatures after purveyor of said second signatures through said second cutting gap.

11. The cutting device of claim 10 wherein each said first holding device, and each said second holding device is a spur strip.

12. The cutting device of claim 11 wherein each said spur strip includes spur needles and further wherein each said spur strip is pivotable around a shaft, wherein a location at which said spur needles cross a circumferential surface of said conveying cylinder is changed in accordance with a pivoted position of said spur strip.

13. The cutting device of claim 11 wherein each said spur strip includes spur needles having spur needle tips, and spur needle bases, and wherein each said spur strip is pivotable about a shaft, said spur needle tips being spaced from said shaft at a first distance, said spur needle base being spaced from said shaft at a second distance, said first distance being greater than said second distance.

14. The cutting device of claim 8 further including a radially displaceable segment on said conveying cylinder, and means extending said radially displaceable segment after passage of said cut ends through said second cutting gaps for separating said cut ends.

15. The cutting device of claim 8 further including a groove on said conveying cylinder, and a strip on said second cutting cylinder, said strip cooperating with said groove for repositioning said cut ends after their passage through said second cutting gap.

16. The cutting device of claim 1 further including a web inlet for each said first transverse cutting assembly and said second transverse cutting assembly.

17. The cutting device of claim 1 further including a folding apparatus, said cutting device being arranged in said folding apparatus.

18. The cutting device of claim 17 wherein said conveying cylinder is a folding blade cylinder.

19. The cutting device of claim 18 wherein the at least one web of material initially contacts said conveying cylinder and then contacts one of said first and second transverse cutting assemblies.

* * * * *